United States Patent [19]

Goud et al.

[11] Patent Number: 5,016,902

[45] Date of Patent: May 21, 1991

[54] SAFETY SKI BINDING

[75] Inventors: Gilles R. Goud, Gevrier; Jean-Pierre Boussemart, Choisy, both of France

[73] Assignee: Salomon S.A., Annecy Cedex, France

[21] Appl. No.: 456,154

[22] Filed: Dec. 22, 1989

[30] Foreign Application Priority Data

Dec. 26, 1988 [FR] France ..... 88 17188

[51] Int. Cl.[5] ..... A63C 9/10

[52] U.S. Cl. ..... 280/630; 280/625; 280/626; 280/629

[58] Field of Search ..... 280/623, 625, 626, 629, 280/630, 634, 636

[56] References Cited

U.S. PATENT DOCUMENTS

| | | | |
|---|---|---|---|
| 3,806,143 | 4/1974 | Wyss | 280/625 |
| 3,902,730 | 9/1975 | Tschida et al. | 280/625 |
| 4,398,747 | 8/1983 | Bernard et al. | 280/630 |
| 4,911,464 | 3/1990 | Gallet et al. | 280/636 |

FOREIGN PATENT DOCUMENTS

| | | | |
|---|---|---|---|
| 1800691 | 11/1969 | Fed. Rep. of Germany | 280/625 |
| 3624387 | 7/1987 | Fed. Rep. of Germany | 280/636 |
| 3900217 | 7/1987 | Fed. Rep. of Germany | 280/625 |
| 2210422 | 7/1974 | France . | |
| 2445729 | 8/1980 | France . | |
| 509810 | 8/1971 | Switzerland . | |

OTHER PUBLICATIONS

Copy of French Search Report.

*Primary Examiner*—Andres Kashnikow
*Assistant Examiner*—Eric Culbreth
*Attorney, Agent, or Firm*—Sandler, Greenblum & Bernstein

[57] ABSTRACT

A safety ski binding includes two lateral retention wings movable about respective journal axes. Two frontal support elements are also journalled about the journal axis and include rolling rear surfaces which support and roll against the sole of a ski boot during lateral release of the boot from the binding. The rolling surfaces includes arcs of a circle having different radii of curvature.

40 Claims, 6 Drawing Sheets

SAFETY SKI BINDING

BACKGROUND OF THE INVENTION

1. Field of the Invention

The present invention is directed to a safety ski binding adapted to maintain the front of a ski boot on the ski.

2. Description of Background Information

Safety bindings of the type according to the present invention are known as "front abutments" and generally comprise a body containing an energization mechanism acting on a retention jaw mounted in the rear part of the body of the front abutment. In certain front abutments, the jaw includes independent wings for lateral retention of the ski boot which are respectively journalled on the body about independent axes, and which are symmetrically arranged with respect to the vertical and longitudinal plane of symmetry of the front abutment. These lateral retention wings are elastically biased by the energization mechanism in the direction of the plane of symmetry of the front abutment so as to grip the front of the boot between the wings.

Such front abutments are described, for example, in French Patent No. 2,210,422 and Swiss Patent No. 509,810. These patents show the use of rollers to support the boot on the jaw that is formed by two journalled wings. More particularly, in the constructions of the front abutments described in these two patents, each lateral retention wing supports two rollers, that is, a lateral roller with a small diameter which is mounted for rotation about an axis at the rear end of the wing, which serves as support for the sole of the boot in the lateral direction, and a central roller of greater diameter than the lateral roller, which is mounted for rotation on an intermediate part of the arm of the wing between the rear end thereof and its journal axis, and which is closer to the plane of symmetry of the front abutment than the extreme lateral roller, and serves as support for the front of the sole in the longitudinal direction.

With such a construction, the large diameter central roller which operates to oppose the longitudinal forces has the disadvantage of "marking" the sole of the boot, since it digs into the material of the sole. This inhibits disengagement during the lateral release of the boot. This disadvantage cannot be eliminated by considerably increasing the radius of curvature of the central roller because the binding would become too bulky.

Another disadvantage of central large diameter rollers which sustain longitudinal forces, is that they have a trajectory imposed by the rotation of the wing about its axis during a lateral release of the front abutment, particularly because the rotation axis of each of these rollers is offset in the direction of the plane of symmetry of the front abutment with respect to the supporting arm of the lateral retention wing. Thus, it is not possible for the contact zone of the central roller to have a predetermined trajectory on the sole during lateral release. Yet, this is significant because the trajectory of the central roller determines the longitudinal movement of the boot in at least one direction during skiing. In fact, the rear binding exerts a thrust on the boot directed towards the front and to this thrust, which is substantially constant, are added occasional thrusts which are due to the flexion of the ski during skiing. Longitudinal thrusts of 200 daN (decanewtons) can be attained in extreme positions. The trajectory of each central roller thus determines the longitudinal engagement of the boot in the jaw (longitudinal movement towards the front connected to the lateral movement towards the exterior of the ski), or even its disengagement (longitudinal movement towards the rear connected to the lateral movement towards the exterior of the ski), or neutral behavior (no longitudinal movement).

Another disadvantage of central rollers is that their functioning deteriorates with wear and tear of the sole. In effect, when the front of the sole is hollowed by grooves or has contours due to wear and tear and repetitive shocks that the boot has endured, the roller catches on these different contours in the sole when the boot moves laterally, which hinders its disengagement. Moreover, to be efficient, each central roller must bear on a relatively hard surface since it has a relatively small diameter. Thus, if the sole of the boot is made of relatively flexible and deformable material, such as with a cross-country ski shoe or boot, the roller has a tendency to sink into the sole, which naturally hinders any lateral movement of the sole. This disadvantage also exists for soles which have a stiff upper part at the front and a layer of flexible material underneath to facilitate walking. In this case, the stiff part has a tendency to wear out more quickly than the flexible layer. As a result, the flexible layer projects from the side and the previously mentioned disadvantage is encountered again with soles of deformable material.

A front abutment as described above has another disadvantage concerning its method of construction. In effect, the central rollers have their own rotation axes which are independent from those of the lateral retention wings and it is thus necessary to provide an axis for each central roller, in addition to the axis of each wing, along with bearings for this axis and all the required secondary elements. This considerably increases the complexity of the binding and its cost.

SUMMARY OF THE INVENTION

It is an object of the present invention to overcome disadvantages of the prior art by providing a safety ski binding with a simplified structure, which is not susceptible to wear and tear of the sole and is suitable for stiff boot soles as well as more flexible soles of the cross-country type and making it possible to control by very simple means, the longitudinal movement of the boot with respect to the jaw during skiing.

The present invention is directed to a safety ski binding, having a front and rear, and which is adapted to hold the front of a boot having a sole on a ski. The safety ski binding includes a body containing an energization mechanism acting on a retention jaw, which includes two independent lateral retention wings which are respectively journalled on the body about independent journal axes and being symmetrically positioned with respect to a vertical and longitudinal plane of symmetry of the binding. The lateral retention wings are elastically biased by the energization mechanism in the direction of the plane of symmetry of the binding. Two frontal support elements are symmetrically positioned with respect to the plane of symmetry, and each includes a rear rolling surface of a substantially cylindrical shape with vertical generating lines, against which the front of the sole of the boot is supported and can roll during a lateral release. Each frontal support element is rotatably mounted about the respective journal axis of the lateral retention wing that is located on the same side of longitudinal plane of symmetry, and the rear rolling surface includes a directrix having a variable radius of curvature.

The rear rolling surface of each frontal support element may have vertical linear generating lines or the generating lines may have a curved shape which is convex towards the rear of the binding.

According to one aspect of the invention, the directrix of the cylindrical rolling surface includes at least two arcs of a circle which are connected to one another. The arcs include radii of curvature which have different centers of curvature. The front of the sole of the boot is in contact at a first point of a first arc of the at least two arcs of a circle which is located on the side of the rolling surface away from the plane of symmetry in the locked position of the binding and at a second point on a second arc of the at least two arcs of a circle which is located on the side of the rolling surface near the plane of symmetry during lateral release movement of the boot in which the edge of the sole moves along the rolling surface.

According to one embodiment, the center of curvature and the radius of curvature of the first arc of a circle are selected such that a line which is perpendicular to the tangent at the first point of contact between the sole of the boot and the rolling surface in the locked position passes into the immediate area of the center of rotation of the journal axis. The center of curvature of the first arc of a circle is spaced towards the front and exterior of the binding with respect to the center of rotation of the journal axis. The center of curvature of the second arc of a circle is spaced towards the exterior and towards the front of the binding with respect to the center of rotation of the journal axis and is spaced towards the rear and towards the exterior of the binding with respect to the center of curvature of the first arc.

According to another embodiment, the center of curvature of the second arc of a circle is located substantially at the center of rotation of the journal axis.

According to another embodiment, the center of curvature of the second arc of a circle is spaced towards the exterior and towards the rear with respect to the center of rotation of the journal axis.

Each frontal support element has substantially the shape of a circular sector in plan view. The rolling surface forms the rear surface of an annular segment which is solidly affixed to a substantially radial arm. The radial arm is journalled at its front end about the journal axis of the lateral retention wing.

When the binding is in the locked position, the two frontal support elements are inclined towards the rear and in the direction of the plane of symmetry, with each radial arm pressing against a respective interior abutment when the binding is in the locked position. The body includes an upper part and a lower base and each interior abutment constitutes an upright connecting the upper part to the lower base. Each interior abutment includes a shock absorbing bumper of elastic material, against which a respective arm of the frontal support element is pushed into contact.

According to another aspect of the invention, the binding includes means for biasing a respective frontal support element towards the plane of symmetry. The biasing means may comprise a compression spring having one end positioned in an opening in an internal surface of a respective lateral retention wing and the other end positioned in an opening in the surface of the annular segment which faces the respective lateral wing.

According to another embodiment, the spring comprises an elastic tongue affixed to the radial arm adjacent the journal axis. The elastic tongue is compressed against an internal surface of the adjacent lateral retention wing so as to continuously bias the frontal support element in the direction of the plane of symmetry.

An internal surface of each lateral retention wing includes an opening at the rear of the journal axis, and a part of the annular segment extends into the opening during lateral release of the boot. A flexible scraping lip is affixed to a respective lateral wing, the flexible scraping lip extends from the lateral retention wing, and the scraping lip rubs on the rolling surface of the frontal support element. The binding further comprises a roller mounted on a rear end of the lateral retention wing, and the flexible scraping lip extends between the opening and the roller.

According to another embodiment, the spring is constituted by an elastic tongue which is affixed to the radial arm. The elastic tongue has an "S" shape and an end is engaged between an internal surface of the lateral retention wing and a plug which is affixed to the lateral retention wing.

BRIEF DESCRIPTION OF THE DRAWINGS

The invention is further explained in the description which follows, by way of non-limiting examples, with reference to the annexed drawings wherein.

Figure 5:
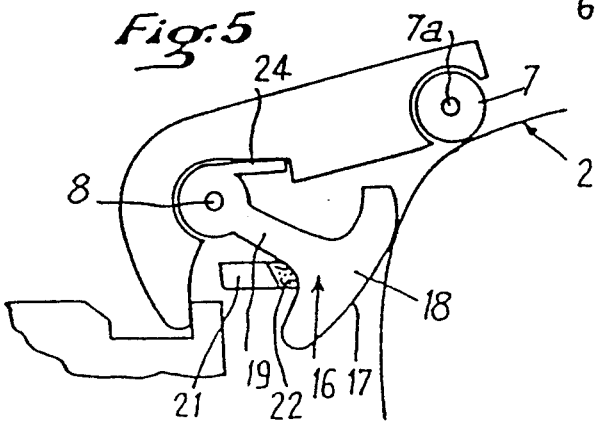
Figure 9:
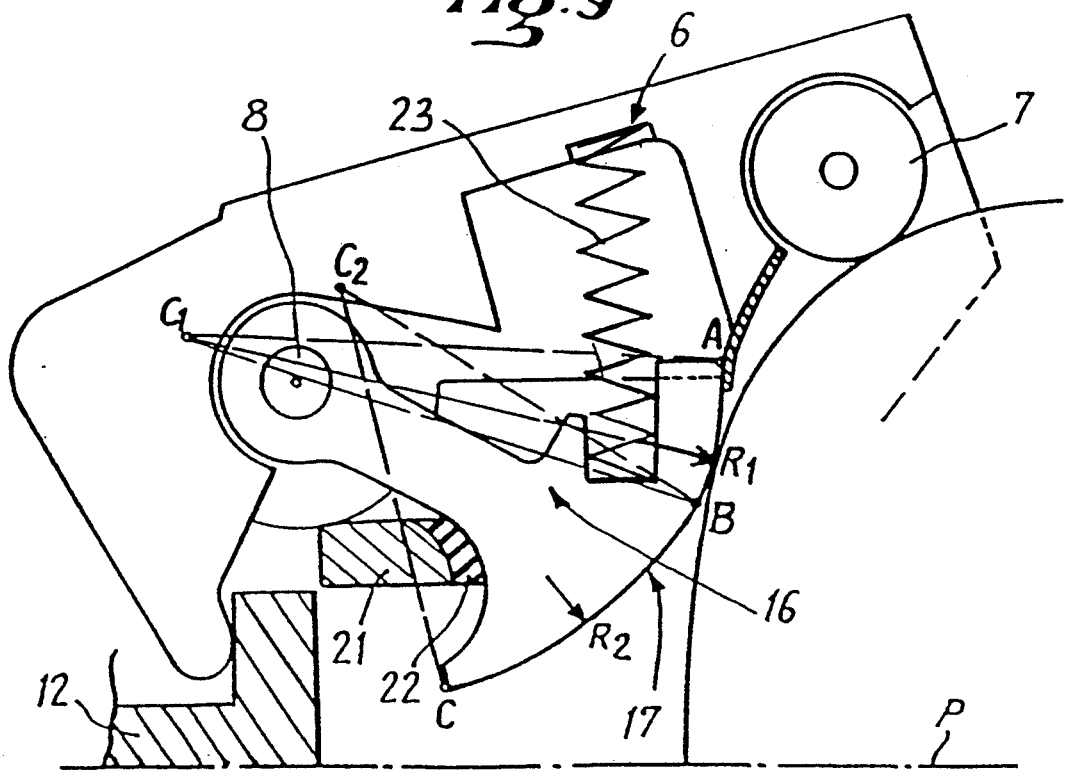
Figure 10:
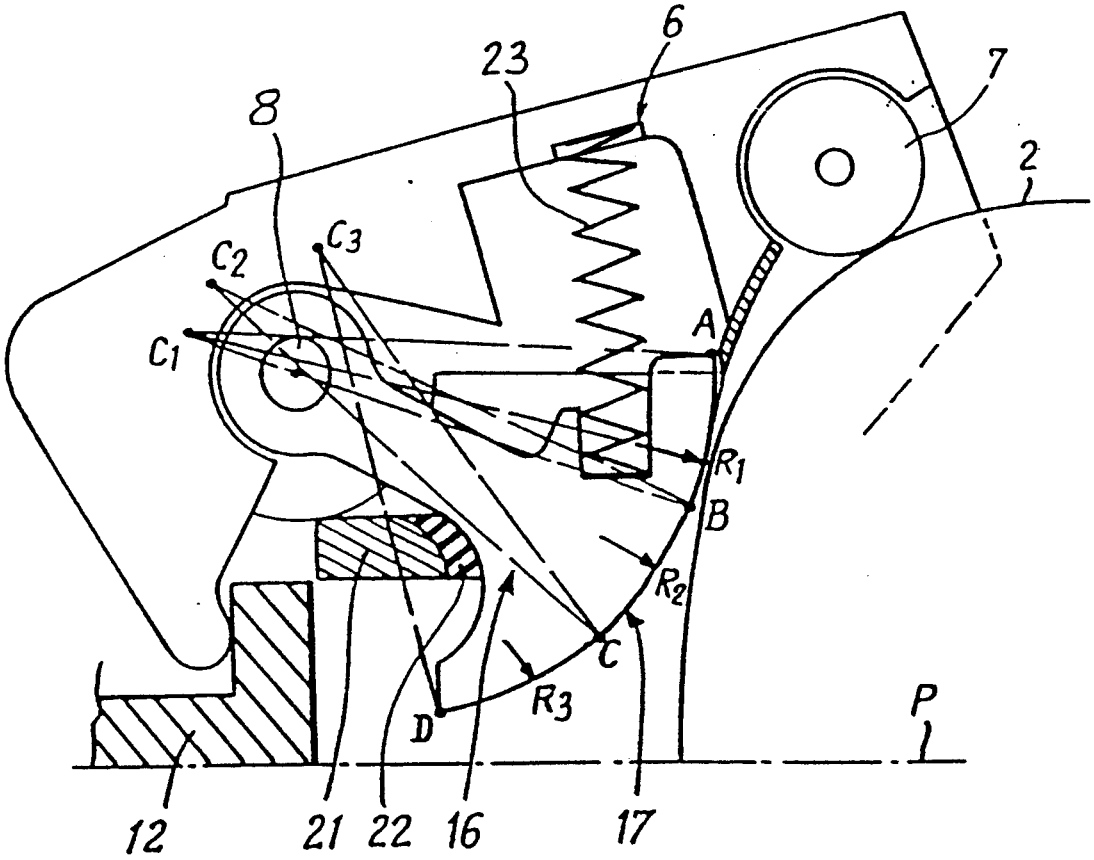
Figure 11:
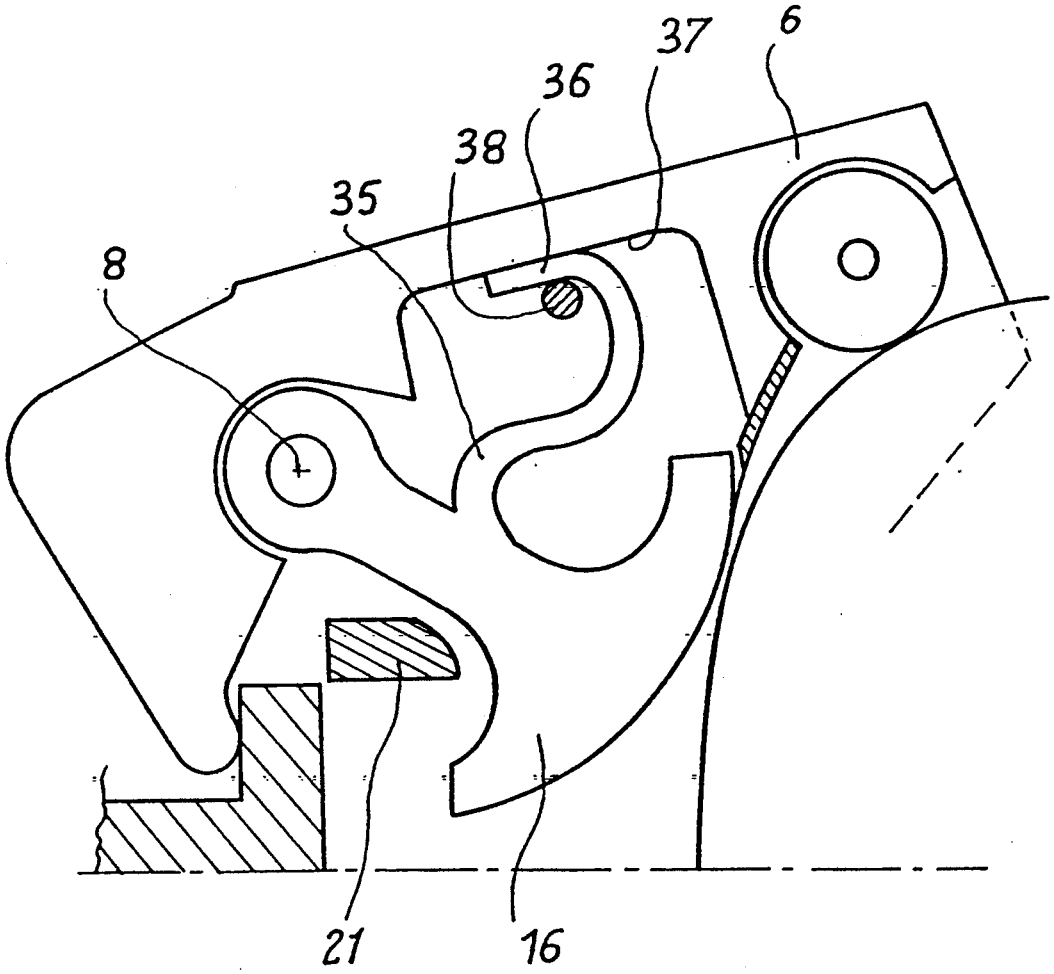

FIG. **4*a*** is a vertical sectional view of a frontal support element of an alternative embodiment having a vertical convex rolling surface;

FIG. 5 is a partial horizontal sectional view of an alternative embodiment of a frontal support element in the form of a rotary sector;

FIGS. 6, 7, 8, 9, 10 are diagrams illustrating the influence of the curvature of a frontal support element in the form of a rotary sector on the movement of the boot during a lateral release; and FIG. 11 illustrates an alternate embodiment of the invention.

DETAILED DESCRIPTION OF THE PREFERRED EMBODIMENTS

The safety ski binding of the present invention is adapted to hold the front of a boot on the ski and includes a body containing an energization mechanism acting on a retention jaw. This jaw is constituted by two independent lateral retention wings which are respectively journalled on the body about independent axes, and which are symmetrically positioned with respect to the vertical and longitudinal plane of symmetry of the binding. These lateral retention wings are elastically biased by the energization mechanism in the direction of the plane of symmetry of the binding. Two frontal support elements are symmetrical with respect to the plane of symmetry of the binding and each have a rolling rear surface of a cylindrical shape having vertical generating lines, against which support and can roll, during lateral release of the front of the sole of the boot. Each frontal support element is mounted for rotation about the journal axis of the lateral retention wing which is located on the same side the rear rolling surface of each support element has a directrix with a variable curvature radius.

The safety ski binding shown in FIGS. 1–4 includes front abutment 1 which is adapted to hold the front end of boot 2 on ski 3. Front abutment 1 comprises body 4 affixed to the ski, which supports, in its rear part, jaw 5 for retention of the front of boot 2. Jaw 5 includes two lateral retention wings 6 which are symmetrically positioned with respect to the vertical and longitudinal plane of symmetry P of front abutment 1. Each lateral retention wing 6 has substantially an L-shape and includes a rear arm 6*a* extending towards the exterior of the ski and towards the rear. Each lateral wing 6 supports at its rear end a small diameter lateral roller 7 which is rotatably mounted on arm 6*a* for rotation about vertical axis 7*a* and is in contact with the sole of boot 2. Each lateral retention wing 6 is journalled on body 4 about vertical axis 8, which is located substantially at the vertex of the L-shape that the wing 6 forms. Lateral wing 6 also includes a short arm 6*b* in front of axis 8 which substantially transversely in the direction of the plane of symmetry P of the front abutment.

Front abutment 1 includes energization mechanism 9 which is lodged in body 4. Energization mechanism 9 is of any appropriate type and, as a non-limiting example, may be a longitudinal tie rod 11 affixed to body 4 and on which is longitudinally slidably mounted a force transmission element constituted by tubular piston 12 which is axially penetrated by tie rod 11. Compression spring 13 is lodged within tubular piston 12. Spring 13 rests, at its front end, on the front end of tubular piston 12, and, at its rear end, on abutment 14 provided at the rear end of tie rod 11. This abutment can be constituted, as is shown in the drawing, by a washer held by a locking nut. As a result, tubular force transmission element 12 is thus constantly biased towards the front by spring 13. Piston 12 has, in its lateral surface, openings 15, which are diametrically opposed in the horizontal direction, and in which the ends of the short transverse arms 6*b* of the lateral retention wings 6 are respectively engaged and are in contact with the rear surfaces of opening 15. As a result, piston 12, which is biased towards the front by spring 13, acts on the transverse arms 6*b* of the lateral retention wings so as to make the rear arms 6*a* of the wings pivot towards one another in the direction of the plane of symmetry P.

According to the invention, front abutment 1 includes two frontal support elements 16, which are symmetrical with respect to the plane of symmetry P and against which the front of the sole of boot 2 rests to hold the front of the boot 2 and to sustain the longitudinal thrust exerted by the boot. Each frontal support element 16 is substantially the shape of a sector of a circle, or "ship anchor", in plan view and includes a rear rolling surface 17 of a cylindrical shape having vertical generating lines whose directrix has a variable radius of curvature, as will be explained below. The vertical generating lines of each rear rolling surface 17 can be linear, as shown in the drawing, or they can have a rounded shape with convexity towards the rear so as to give a convex shape to rolling surface 17, as shown in FIG. 4*a*. Rolling surface 17 constitutes the rear surface of element 18 which is in the form of an annular segment which is solidly affixed to a substantially radial arm 19 which is journalled at its front end about journal axis 8 of the lateral retention wing 6 on body 4.

Figure 1:
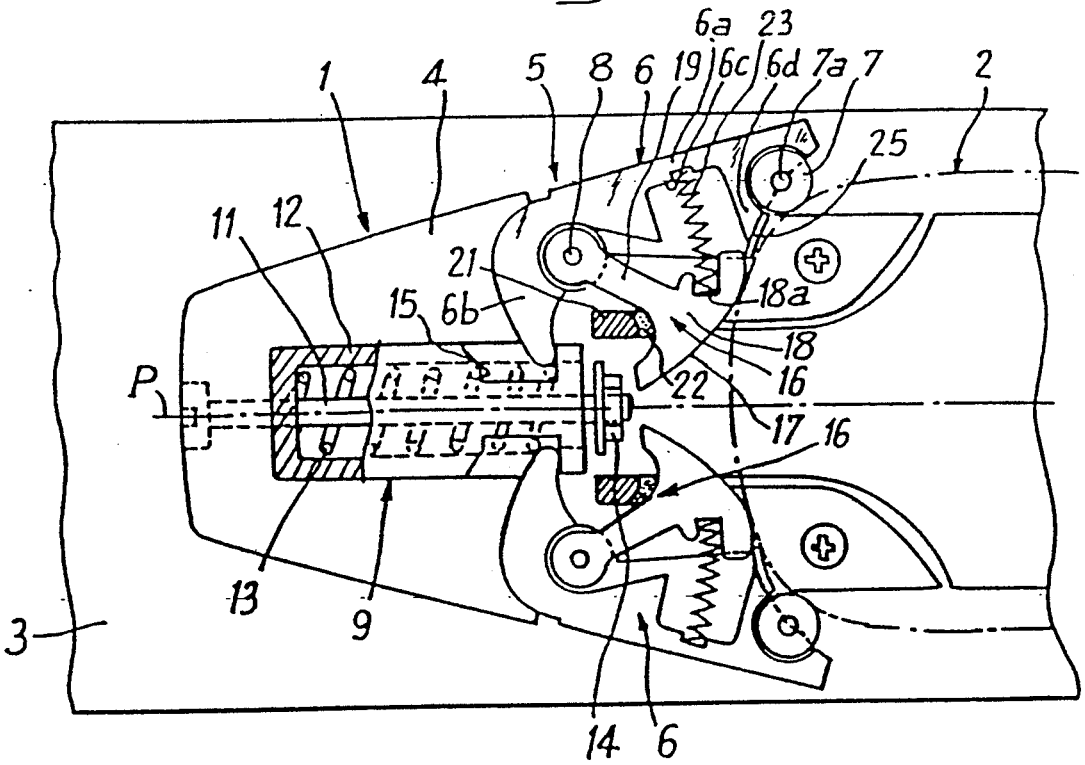
FIG. 1 is a schematic horizontal sectional view of a front abutment, according to the invention.
Figure 2:
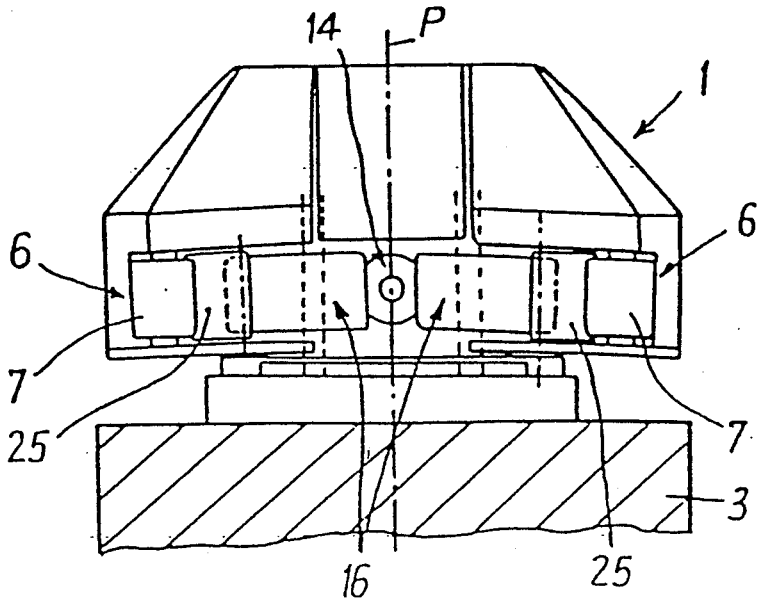
FIG. 2 is a rear view of the front abutment of FIG. 1.

In the position shown in FIGS. 1 and 2, the two frontal support elements 16 are inclined towards the rear and in the direction of the plane of symmetry P and at an acute angle with this plane. They are respectively pressed by their arms 19 against two interior abutments 21 near plane P. Abutments 21 are also uprights connecting the upper part of body 4 to its lower base, thus contributing to stiffening the body 4. Each interior abutment 21 preferably includes a shock absorbing bumper 22 of elastic material on its surface, against which arm 19 of frontal support element 16 is pushed into contact in the locking position.

Each frontal support element 16, which is in the form of a cylindrical sector, is normally pushed towards the interior, i.e., towards the plane of symmetry P, by a return spring. This return spring can be constituted by compression spring 23 whose ends are respectively lodged in an opening 6*c* formed in the internal surface of rear arm 6*a* of the adjacent lateral retention wing 6 and in an opening 18*a* formed in the surface of the annular segment 18 which faces towards the exterior, i.e., towards wing 6.

According to an alternative embodiment, as shown in FIG. 5, the return spring of frontal support element 16 can be constituted by an elastic tongue 24 which is solidly affixed to an extreme part of arm 19 adjacent journal axis 8, and which is compressed against an internal surface near the adjacent wing 6 so as to continuously bias frontal support element 16 in the direction of the plane of symmetry P.

The internal surface of each lateral retention wing 6 is hollowed, between its journal axis 8 and the small diameter lateral roller 7 which is mounted at its rear end, at opening 6*c* containing spring 23 and in which is engaged the extreme external part of the annular segment 18 of frontal support element 16 during lateral release, as described below. Opening 6*c* is formed such that there exists a very small amount of play between its wall and the extreme part of annular segment 18 when segment 18 is engaged in the opening 6*c*, so as to avoid the accidental introduction of snow in this area. Moreover, to reinforce the sealing at this location, the opening which exists between the end of annular segment 18 and the entrance of opening 6*c* in the locking position is sealed by flexible scraping lip 25 which is affixed to the external surface of part 6*d* of rear arm 6*a* of wing 6 which extends between opening 6*c* and the housing of the small diameter lateral roller. Lip 25 also ensures the scraping of support surface 17, because its free end is in contact with this support surface.

As described above, the directrix of each cylindrical rolling surface 17 of frontal support element 16 includes at least two arcs of different radii of curvature. This is clearly shown in FIG. 6 where the directrix of rolling surface 17 is constituted by two arcs of a circle AB and BC which are connected to one another and include respective radii of curvature R1 and R2. The arc of a circle AB of radius of curvature R1 extends from a point A, which is situated at the exterior end, i.e., away from plane P, of rolling surface 17. The arc AB, which is an arc of a circle whose center C1, is situated towards the exterior and towards the front with respect to the center O of journal axis 8, which is common to lateral retention wing 6 and to frontal support element 16. The second arc of a circle BC, of radius R2, has for its center a point C2 which is also situated in front and towards the exterior with respect to center O, and at the rear and towards the exterior with respect to the center C1. In the locking position, the front of sole 2 is in contact with rolling surface 17 at point $x_1$ which is part of arc AB of radius R1. The center of curvature C1 for the arc of a circle AB is positioned such that the line $x_1$C1 is perpendicular to the tangent at the point of contact $x_1$ and passes substantially through the immediate position of center O of rotation axis 8 of wing 6 and frontal support element 16. As a result, the longitudinal thrust f that the sole of boot 2 exerts on frontal support element 16 has a substantially neutral effect on the rotation of the frontal support element 16, i.e., not only when stopped or during skiing on flat terrain, but even during the flexing of the ski while skiing on uneven terrain.

Figure 3:
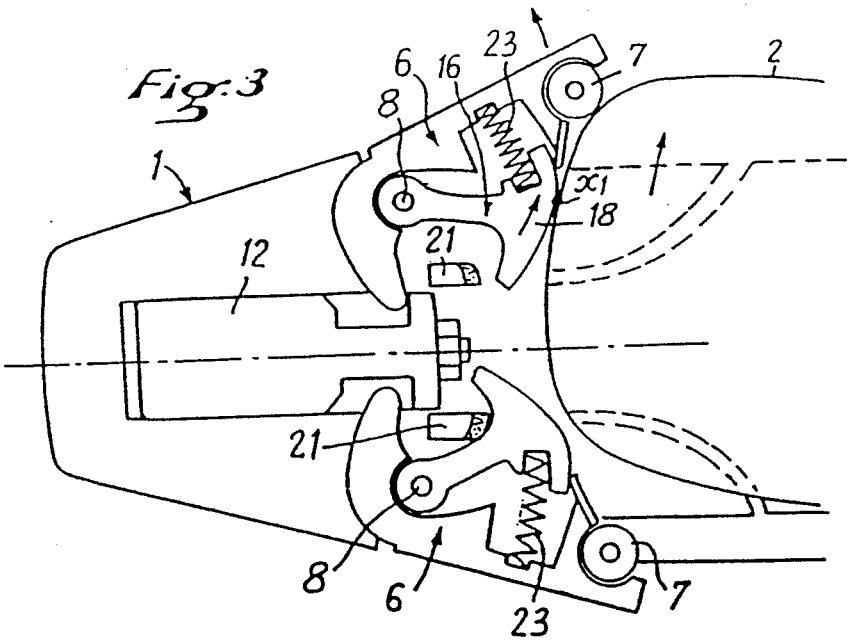
FIG. 3 is a schematic horizontal sectional view of the front abutment of FIG. 1, at the beginning of a lateral release movement.
Figure 4:
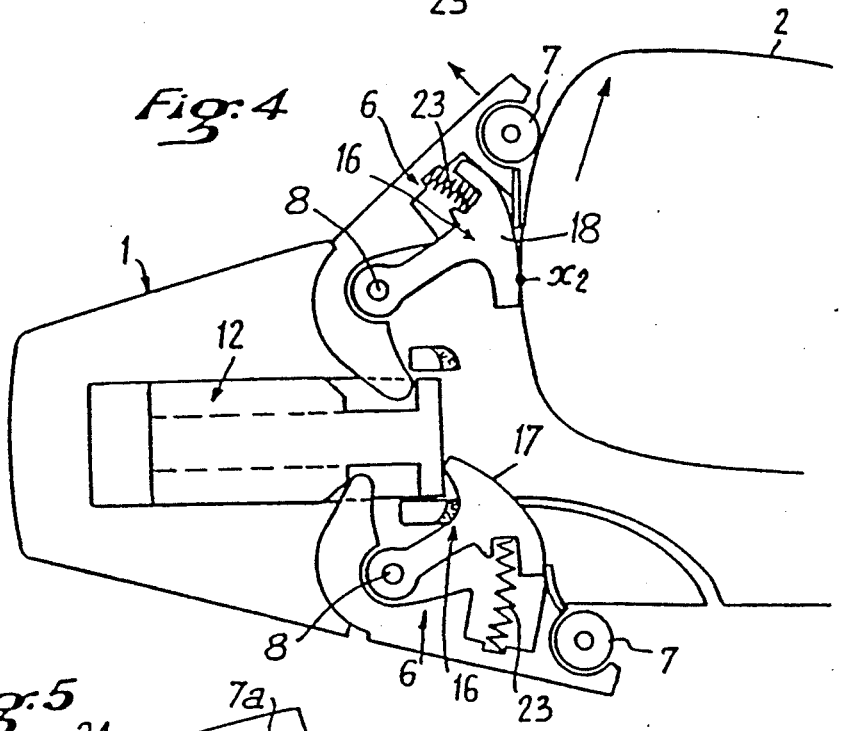
FIG. 4 is a schematic horizontal sectional view of the front abutment of FIG. 1 at the end of the lateral release movement.
Figure 4A:
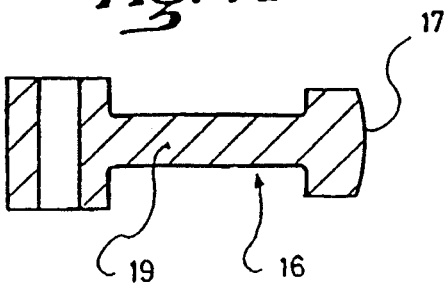
Figure 7:
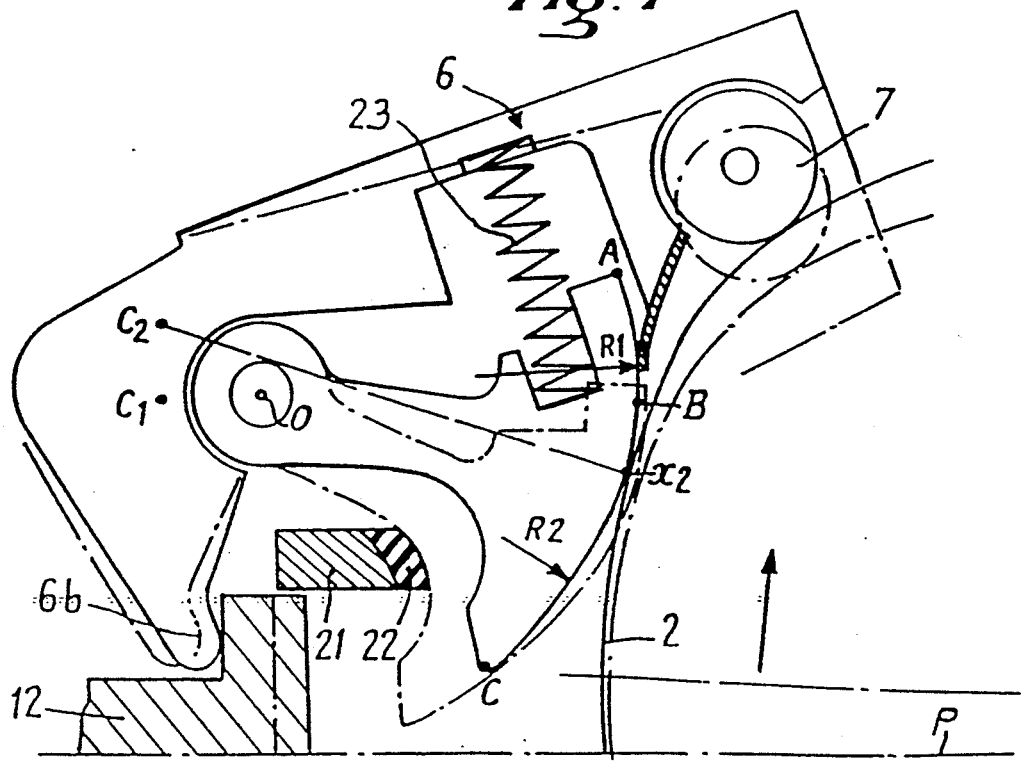

At the time of release of the front abutment, sole 2 of the boot moves towards the exterior, for example, upwardly as shown in FIGS. 3, 4 and 7, by moving by the front edge of the sole the wing 6 and frontal support element 16 on which it rolls. In the course of the lateral release movement, the front of the sole is in contact with the rolling surface 17 of frontal support element 16 at a point $x_2$ which moves on the arc of a circle BC. The radius of curvature R2 of arc BC and the position of its center C2 are selected so as to give a neutral or slightly positive effect, i.e., to the release of the boot when the boot is released. In other words, the distance between the point of instantaneous contact $x_2$ and the center O of rotation axis 8 varies during the lateral release movement depending on the longitudinal movement that is desired for the boot. Given that the shape of the front of the sole is standardized and that usually this front is rounded towards the front by approximately 4 mm, the position of the center of curvature C2 is selected so as to generate a slight disengaging effect, i.e., it causes a slight longitudinal movement towards the front of the point of contact $x_2$ between the sole of the boot and rolling surface 17 and, thus, a longitudinal movement which is substantially zero, of the sole when taking into account the rounding of the sole towards the front. As a result, the sole does not undergo longitudinal movement, or substantial longitudinal movement, during the lateral release. However, this is not limiting and other profiles of the directrix of the rolling surface 17 can be used, as will be described below with reference to FIGS. 8, 9, 10.

Figure 6:
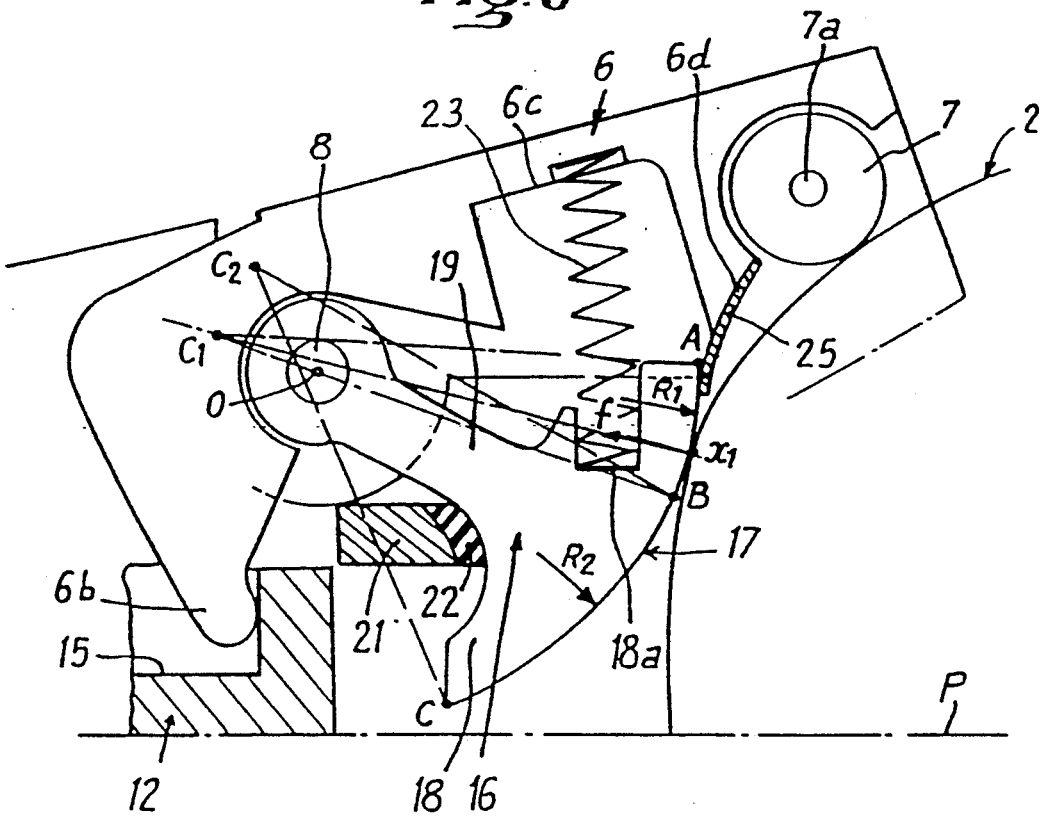

As described above, in the interlocking position, each frontal support element 16 rests against a shock absorbing bumper 22 which is supported by an interior abutment 21. Each of these shock absorbing bumpers 22 has a function during a lateral release in the direction of the side of the ski opposite to where it is located. More particularly, as seen in FIG. 6, and assuming that boot 2 moves laterally downwardly in this figure, during a lateral downward release by pushing towards the exterior the lower lateral retention wing 6 (not shown in FIG. 6), the sole of boot 2, which is in contact at point $x_1$ with rolling surface 17 of upper frontal support element 16, which located on the side opposite that towards which the lateral release is carried out, tends to move this upper frontal support element 16, in the direction of symmetry plane P, i.e., by making it pivot clockwise about axis 8. This pivoting movement is possible because of the presence of shock absorbing bumper 22 which is compressed until sole 2 escapes upper frontal support element 16, i.e., when the boot has totally transferred its longitudinal support to lower frontal support element 16. As soon as the edge of the sole of boot 2 separates from the rolling surface 17 of upper frontal support element 16, the latter is pushed by shock absorbing bumper 22 which functions as a return spring.

Figure 8:
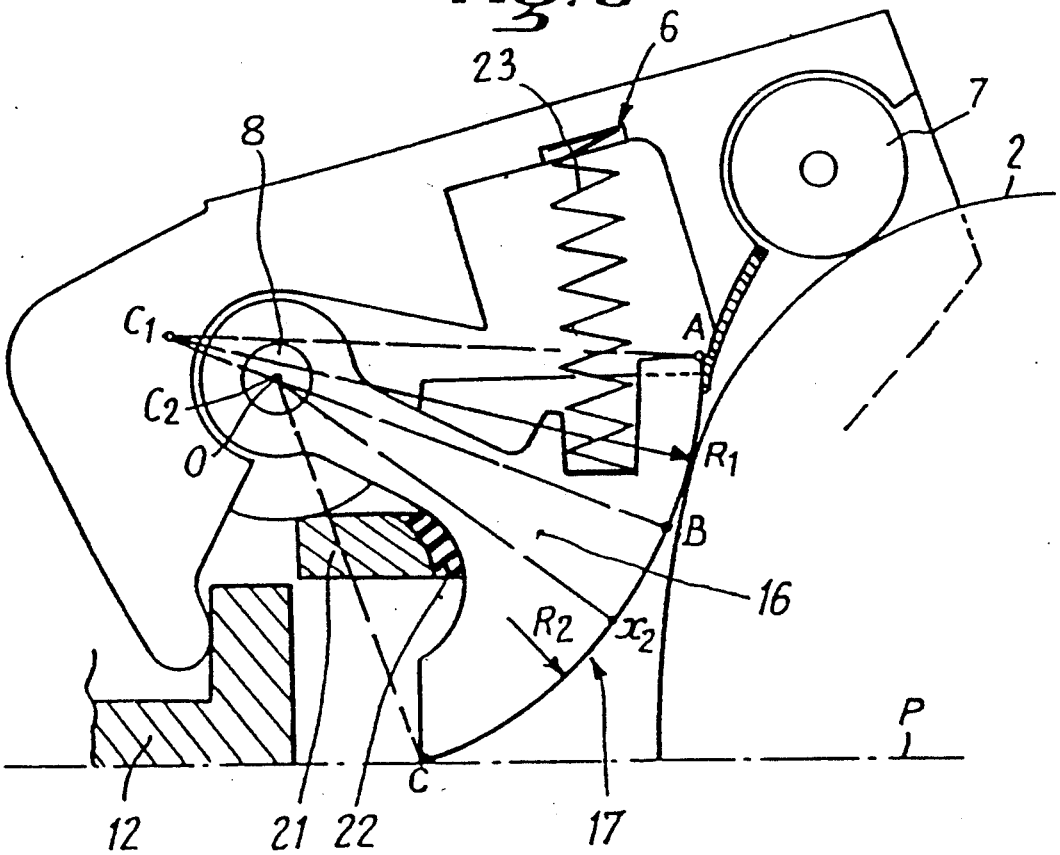

In the embodiment shown in FIG. 8, the center of curvature C2 of arc BC is the same as the center O of rotation axis 8, while the center of curvature C1 of arc AB is at the same location as in the embodiment of FIG. 6. In this case, the point of contact $x_2$ on arc BC, in the course of the lateral release movement, is still located at the same distance from center O of rotation axis 8, during this movement, but because the front of the sole is rounded, the boot moves slightly rearwardly. Moreover, when in the course of the lateral release movement, the front of the sole is in contact with a point $x_2$ of arc BC, the frontward thrust exerted by the boot is directed towards the center O of rotation axis 8 and consequently it has a neutral effect on frontal support element 16.

In the alternative embodiment shown in FIG. 9, the center of curvature Cl is at the same location as in the embodiments illustrated in FIGS. 6 and 8 but the center of curvature C2 is located towards the rear and towards the exterior with respect to the center O of rotation axis 8. In this case, the arc of circle BC "disengages" from the boot and, taking into account the roundness of the front of the sole, the boot moves forwardly in the course of the lateral release movement. The tangential component of the thrust of the boot allows movement towards the exterior of frontal support element 16 and thus the release of the boot.

In the alternative embodiment shown in FIG. 10, the rolling surface 17 is constituted by three arcs of a circle, namely, the arc AB of radius of curvature R1 and center of curvature C1, the arc BC of radius of curvature R2 and of curvature center C2, and an additional arc CD of radius of curvature R3 and of curvature center C3, these arcs extending in this order from the exterior towards the interior. The arcs AB and BC function the same as the arcs AB and BC in the preceding embodiments, but arc CD of radius R3 against which the sole of the boot comes into contact after release, is truly "disengaged", which causes a forward movement of the boot and a significant component of the thrust towards the exterior.

FIG. 11 shows an alternative embodiment in which rotary sector 16 includes an elastic tongue 35 in the shape of an "S", which constitutes the elastic return element of the sector. The end 36 of tongue 35 is engaged between the internal surface 37 of wing 6, and a plug 38 which is solidly affixed to wing 6.

The "S" shape of tongue 35 makes it possible for the elastic return of sector 16 in its two pivoting directions about axis 8. Thus, when the boot sole moves the rotary sector 16 in the direction of adjacent wing 6, the tongue 35 is compressed, which ensures its elastic return after the end of the biasing. In the case where the boot biases sector 16 towards the interior of the ski, as previously described, tongue 35 is relaxed until the sector rests against its interior abutment 21. When the boot has been released from contact of the rotary sector, the tongue returns sector 16 to its initial position.

Although the invention has been described with reference to particular means, materials and embodiments, it is to be understood that the invention is not limited to the particulars disclosed and extends to all equivalents within the scope of the claims.

We claim:

1. A safety ski binding, having a front and rear, adapted to hold the front of a boot having a sole in a locked position on a ski, said safety ski binding comprising a body containing an energization mechanism acting on a retention jaw, said retention jaw including two independent lateral retention wings respectively journalled on said body about independent journal axes and being symmetrically positioned with respect to a vertical and longitudinal plane of symmetry of the binding, said lateral retention wings being elastically biased by said energization mechanism in the direction of the plane of symmetry of the binding, two frontal support elements symmetrically positioned with respect to the plane of symmetry, each frontal support element having a rear rolling surface of a substantially arcuate shape with a vertical surface, against which the front of the sole of the boot is support and is allowed to roll during a lateral release, wherein each frontal support element is rotatably mounted about the respective journal axis of the lateral retention wing that is located on the same side of longitudinal plane of symmetry, each said front support element being able to rotate relative to a respective lateral retention wing, and said rear rolling surface includes a directrix having a variable radius of curvature.

2. The safety ski binding according to claim 1, wherein the rear rolling surface of each frontal support element is vertical.

3. The safety ski binding according to claim 1, wherein the rear rolling surface of each frontal support surface has a curved shape being convex towards the rear of the binding.

4. The safety ski binding according to claim 1, wherein the directrix of the cylindrical rolling surface includes at least two arcs of a circle which are connected to one another, said arcs including radii of curvature which have different centers of curvature, the front of the sole of the boot being in contact at a first point of a first arc of said at least two arcs of a circle which is located on the side of said rolling surface away from said plane of symmetry in the locked position of the binding and at a second point on a second arc of said at least two arcs of a circle which is located on the side of the rolling surface near the plane of symmetry during lateral release movement of the boot in which the edge of the sole moves along said rolling surface.

5. The safety ski binding according to claim 4, wherein the center of curvature and the radius of curvature of said first arc of a circle are selected such that a line which is perpendicular to the tangent at said first point of contact between the sole of the boot and said rolling surface in the locked position of the binding passes into the immediate area of the center of rotation of said journal axis, the center of curvature of said first arc of a circle being spaced towards the front and exterior of the binding with respect to the center of rotation of said journal axis.

6. The safety ski binding according to claim 5, wherein the center of curvature of said second arc of a circle is spaced towards the exterior and towards the front of the binding with respect to the center of rotation of said journal axis and being spaced towards the rear and towards the exterior of the binding with respect to the center of curvature of said first arc.

7. The safety ski binding according to claim 5 wherein the center of curvature of said second arc of a circle is located substantially at the center of rotation of said journal axis.

8. The safety ski binding according to claim 5 wherein the center of curvature of said second arc of a circle is spaced towards the exterior and towards the rear with respect to the center of rotation of said journal axis.

9. The safety ski binding according to claim 1, wherein each frontal support element has substantially the shape of a circular sector in plan view.

10. The safety ski binding according to claim 9, wherein said rolling surface forms the rear surface of an annular segment which is solidly affixed to a substantially radial arm, said radial arm including a front end, said radial arm being journalled at its front end about said journal axis of said lateral retention wing.

11. The safety ski binding according to claim 10, wherein when said binding is in the locked position, said two frontal support elements are inclined towards the rear and in the direction of the plane of symmetry, each said radial arm pressing against a respective interior abutment when said binding is in the locked position.

12. The safety ski binding according to claim 11, wherein said body includes an upper part and a lower base, each interior abutment constitutes an upright connecting said upper part to said lower base.

13. The safety ski binding according to claim 11, wherein each interior abutment includes a shock absorbing bumper of elastic material, against which a respective arm of the frontal support element is pushed into contact.

14. The safety ski binding according to claim 10, further comprising a spring for biasing a respective frontal support element towards the plane of symmetry.

15. The safety ski binding according to claim 14, wherein said spring comprises a compression spring having one end positioned in an opening in an internal surface of a respective lateral retention wing, and the other end being positioned in an opening in the surface of said annular segment which faces said respective lateral wing.

16. The safety ski binding according to claim 14, wherein said spring comprises an elastic tongue affixed to said radial arm adjacent said journal axis, said elastic tongue being compressed against an internal surface of the adjacent lateral retention wing so as to continuously bias said frontal support element in the direction of said plane of symmetry.

17. The safety ski binding according to claim 10, wherein an internal surface of each lateral retention wing includes an opening at the rear of said journal axis, a part of said annular segment extending into said opening during lateral release of the boot.

18. The safety ski binding according to claim 17, further comprising a flexible scraping lip being affixed to a respective lateral wing, said flexible scraping lip extending from said lateral retention wing, said scraping lip rubbing on said rolling surface of said frontal support element.

19. The safety ski binding according to claim 18, further comprising a roller mounted on a rear end of said lateral retention wing, said flexible scraping lip extending between said opening and said roller.

20. The safety ski binding according to claim 14, wherein said spring is constituted by an elastic tongue which is affixed to said radial arm, said elastic tongue having an "S" shape and having an end engaged between an internal surface of said lateral retention wing and a plug which is affixed to said lateral retention wing.

21. A safety ski binding having a front and rear and a longitudinal plane of symmetry, and being adapted to hold a ski boot having a sole on a ski, said binding having a locked position and a release position, said safety binding comprising:

(a) a body;

(b) a retention jaw including two lateral retention wings being journalled on said body for movement about respective journal axes, each said journal axis being located on opposite sides of said plane of symmetry;

(c) an energization mechanism for elastically biasing each of said lateral retention wings towards said plane of symmetry;

(d) two frontal support elements, each being journalled on said body adjacent a respective lateral retention wing, each frontal support element being able to rotate relative to a respective lateral retention wing, said frontal support elements each including a rolling surface, the sole of the boot being adapted to contact and move with respect to each said rolling surface during release of the boot from the binding, said rolling surface having a directrix having a variable radius of curvature.

22. The safety binding according to claim 21, wherein said rear rolling surface is formed by a vertical surface.

23. The safety binding according to claim 21, wherein said rear rolling surface is formed by a curved surface.

24. The safety binding according to claim 23, wherein said curved surface if convex in the direction of the rear of the binding.

25. The safety binding according to claim 21, wherein each frontal support element is journalled on said body for movement about the journal axis of a respective lateral retention wing.

26. The safety binding according to claim 25, said directrix of each said rolling surface comprising a first and a second arc of a circle, said first and second arcs being connected to one another, the sole of the boot contacting a first point on said first arc when the binding is in the locked position and contacting a second point on said second arc during release of the boot from the binding.

27. The safety binding according to claim 26, wherein said first and second arcs have different centers of curvature, the center of curvature of said first arc being spaced towards the front of the binding and farther from said plane of symmetry with respect to the center of rotation of said journal axis.

28. The safety binding according to claim 27, wherein the center of curvature of said second arc is spaced towards the rear of the binding and farther from said plane of symmetry with respect to the center of curvature of said first arc.

29. The safety binding according to claim 27, wherein the center of curvature of said second arc is located substantially at the center of rotation of said journal axis.

30. The safety binding according to claim 27, wherein the center of curvature of said second arc is spaced towards the rear of the binding with respect to the center of rotation of said journal axis.

31. The safety binding according to claim 25, wherein each frontal support element comprises a radial arm journalled at one end about said journal axis, an annular segment being fixed to the other end of said radial arm, a rear surface of said annular segment forming said rolling surface.

32. The safety binding according to claim 31, said binding including two interior abutments on opposite sides of said plane of symmetry, each radial arm pressing against a respective interior abutment when the binding is in the locked position.

33. The safety binding according to claim 32, wherein said body includes an upper part and a base, each interior abutment connecting said upper part to said base.

34. The safety binding according to claim 32, wherein each interior abutment includes shock absorbing material.

35. The safety binding according to claim 31, further comprising means for biasing each frontal support element towards said plane of symmetry.

36. The safety binding according to claim 35, wherein said means for biasing includes a spring having one end connected to said lateral retention wing and the other end connected to a respective frontal support element.

37. The safety binding according to claim 36, wherein said other end of the spring is connected to said annular segment.

38. The safety binding according to claim 35, wherein said means for biasing comprises an elastic tongue, said tongue being affixed to said radial arm adjacent said journal axis and being compressed against an adjacent lateral retention wing so as to continuously bias said frontal support element in the direction of said plane of symmetry.

39. The safety binding according to claim 35, including a plug affixed to said lateral retention wing, said means for biasing comprising an elastic tongue having a substantially S-shape with one end attached to said radial arm and the other end engaged between said plug and said internal surface.

40. The safety binding according to claim 21, further comprising a scraping lip for scraping the rolling surface of said frontal support element.

* * * * *

UNITED STATES PATENT AND TRADEMARK OFFICE

CERTIFICATE OF CORRECTION

PATENT NO. : 5,016,902

DATED : May 21, 1991

INVENTOR(S) : G. RENAUD GOUD et al.

It is certified that error appears in the above-identified patent and that said Letters Patent is hereby corrected as shown below:

On title page, item [75], inventors, change "Gilles R. Goud, Gevrier" to --Gilles Renaud Goud, Cran Gevrier;

line 6 of the abstract, change "includes" to ---include---.

At column 11, line 28 (claim 24, line 2), change "if convex" to ---is convex---.

Signed and Sealed this

Ninth Day of March, 1993

*Attest:*

STEPHEN G. KUNIN

*Attesting Officer*

*Acting Commissioner of Patents and Trademarks*